United States Patent [19]

Tsubata

[11] 3,951,181

[45] Apr. 20, 1976

[54] CARRIER TAPE FOR SLIDING CLASP FASTENERS

[75] Inventor: Noritaka Tsubata, Uozu, Japan

[73] Assignee: Yoshida Kogyo Kabushiki Kaisha, Japan

[22] Filed: Jan. 20, 1975

[21] Appl. No.: 542,551

[30] Foreign Application Priority Data

Jan. 26, 1974 Japan ..... 49-11564[U]

[52] U.S. Cl. ..... 139/384 B; 24/205.16 C

[51] Int. Cl.[2] ..... D03D 3/00; A44B 19/02

[58] Field of Search ..... 139/384 B, 384 R, 11, 139/116; 24/205.1 C, 205.13 C, 205.16 C, 205.16 R; 112/265

[56] References Cited

UNITED STATES PATENTS

| | | | |
|---|---|---|---|
| 2,236,033 | 5/1941 | Killmer | 139/384 B |
| 2,400,924 | 5/1946 | Fite, Jr. | 139/384 B |
| 2,405,902 | 8/1946 | Poux | 139/384 B |
| 2,940,478 | 6/1960 | Hendley | 139/384 B |
| 3,820,202 | 6/1974 | Takamatsu | 24/205.1 C |

FOREIGN PATENTS OR APPLICATIONS

| | | | |
|---|---|---|---|
| 1,542,750 | 9/1968 | France | 24/205.16 C |

*Primary Examiner*—James Kee Chi

*Attorney, Agent, or Firm*—Bucknam and Archer

[57] ABSTRACT

A carrier tape for sliding clasp fasteners is provided which comprises a weave foundation consisting of warp and weft threads made of filamentary plastics material, and a plurality of inlaid threads interwoven into the foundation and extending longitudinally in parallel with the warp threads. The inlaid threads are greater in denier than the foundation threads and form a multiplicity of ridges which project from and above at least one surface of the foundation and which are spaced longitudinally apart by a predetermined pitch.

2 Claims, 4 Drawing Figures

CARRIER TAPE FOR SLIDING CLASP FASTENERS

BACKGROUND OF THE INVENTION

This invention relates to a carrier tape for sliding clasp fasteners and has particular reference to a woven carrier tape for carrying thereon interlocking fastener elements.

There are known various types of woven tapes for use in sliding clasp fasteners. One such known woven tape is constructed of synthetic resin filaments for warp threads and/or weft threads which form a foundation fabric. However, due primarily to the extremely low friction coefficient of the plastics material, the resultant carrier tape has the drawback that when it is sewn to a garment or the like, the tape is prone to slip out of engagement with a feed dog of a sewing machine, so that irregularities take place in the advancement of the tape and garment and hence the tape often fails to be sewn into the proper position relative to the garment.

SUMMARY OF THE INVENTION

With the above-noted drawback of the prior art in mind, it is an object of this invention to provide an improved carrier tape for sliding clasp fasteners which incorporates structural features designed to eliminate the slippage of the tape relative to the feed dog of the sewing machine during the attachment of the tape to a garment or the like.

Briefly stated, the carrier tape according to the invention comprises a weave foundation consisting of warp and weft threads made of a filamentary plastics material; and a plurality of inlaid threads interwoven into said foundation and extending longitudinally in parallel with said warp threads, said inlaid threads being greater in denier or thickness than the foundation threads and forming a multiplicity of ridges which project from and above at least one surface of said foundation and which are spaced longitudinally apart by a predetermined pitch.

DESCRIPTION OF THE PREFERRED EMBODIMENT

Figure 1:
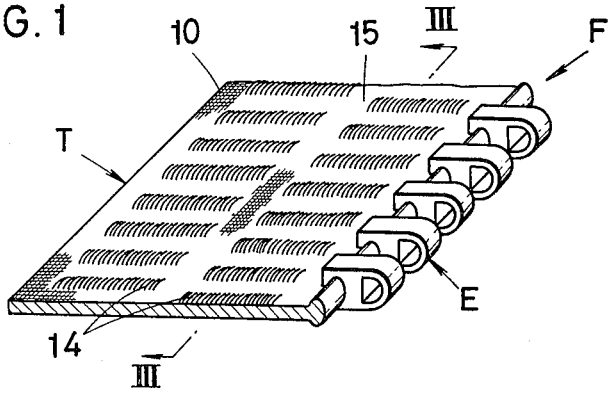
FIG. 1 is a fragmentary perspective view of a carrier tape embodying the invention and shown carrying interlocking fastener elements thereon.

Referring now to FIG. 1, there is shown a fastener stringer F which comprises a carrier tape T constructed in accordance with this invention and a row of interlocking fastener elements E mounted on and along a longitudinal marginal edge of the tape. The carrier tape T includes a foundation 10 having a plain-weave pattern.

Figure 2:
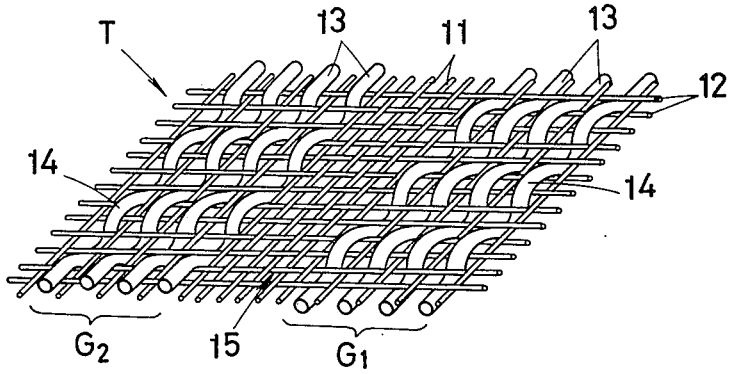
FIG. 2 is an enlarged perspective view of the carrier tape, illustrating its structural details.
Figure 3:
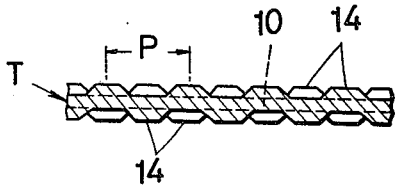
FIG. 3 is a cross-sectional view taken on the line III—III of FIG. 1.
Figure 4:
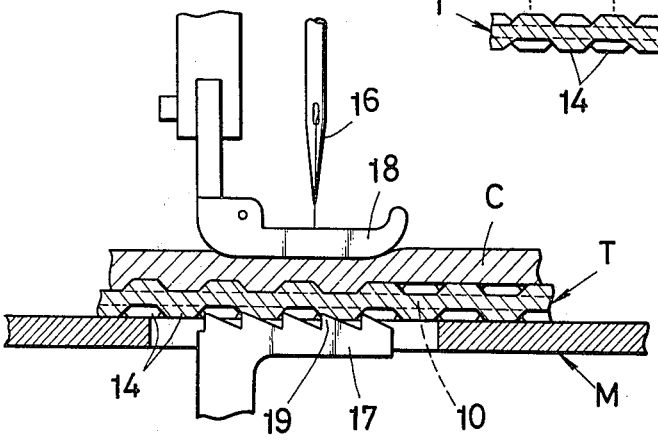
FIG. 4 is a view similar to FIG. 3 but illustrating the tape as being sewn to a garment fabric on a sewing machine.

As better illustrated in FIG. 2, the foundation 10 is comprised of longitudinally extending warp threads 11 and transversely extending weft threads 12 passing alternately over and under the warp threads 11. According to an important aspect of this invention, there are provided a plurality of longitudinally extending inlaid threads 13 which are interwoven into the foundation 10 in parallel relation to the warp threads 11. The inlaid threads 13 are arranged to alternately overlie and underlie a plurality of weft threads 12 or in the illustrated embodiment every two weft threads 12. The inlaid threads 13 may be made of the same material as the foundation threads 11,12 or a textile material, but they should be greater in denier than the foundation threads in order to achieve the results hereafter described. As seen in FIG. 2, FIG. 3 or FIG. 4, the inlaid threads 13, being larger in denier or thickness, provide a multiplicity of ridges or protuberances 14 which are formed symmetrically on both surfaces of the tape T but are spaced longitudinally apart, as viewed in one such surface, by a predetermined pitch P which substantially corresponds to a length of two teeth of a feed dog 17 later described. In accordance with the illustrated embodiment, there are employed a first group $G_1$ and a second group $G_2$ of inlaid threads 13 arranged such that the ridges 14 of the first group $G_1$ are displaced half of the pitch P with respect to those of the second group $G_2$. Defined between the two groups of inlaid threads 13 is a ridge-free region 15 for the passage therethrough of a sewing needle 16 (FIG. 4).

Referring now to FIG. 4 which is utilized to explain the operation of sewing the carrier tape T onto the garment C, it will be seen that the tape T is held at one surface thereof in contact with the feed dog 17 and at the other surface with the garment C which is pressed downwardly by a presser foot 18 of the machine M. Thus, the tape T and garment C are held in sandwiched relation by the presser foot 18 and feed dog 17 and are advanced in one direction progressively as the feed dog 17 drives the tape T in the usual manner. It will be appreciated that during the advancing movement of the tape T together with the garment C, this movement can be effected smoothly without slippage of the tape T with respect either to the feed dog 17 in particular or to the garment C by the provision of ridges or protuberances 14 projecting from and above both surfaces of the fundation 10 for gripping engagement primarily with the teeth 19 of the feed dog 17 as seen in FIG. 4. Slippage of the tape T relative to the garment C is also prevented by the ridges 14 of the tape T which bite into the fabric of the garment C as the latter is urged by the presser foot 18 down against the tape T as illustrated in FIG. 4.

Having thus described the invention, it will be understood that various changes and modifications may be made in the specific form and construction herein advanced, without departing from the scope of the appended claims.

What is claimed is:

1. A carrier tape for sliding clasp fasteners comprising: a weave foundation consisting of warp and weft threads made of a filamentary plastics material; and a plurality of inlaid threads interwoven into said foundation and extending longitudinally in parallel with said warp threads, said inlaid threads being greater in thickness than the foundation threads and forming a multiplicity of ridges which project from and above at least one surface of said foundation and which are spaced longitudinally apart by a predetermined pitch substantially corresponding to a length of two teeth of a sewing machine feed dog, said inlaid threads being arranged to alternately overlie and underlie a plurality of weft threads, said ridges being separated into two groups by a ridge-free region of the foundation, said groups of ridges being disposed for gripping engagement with such feed dog teeth to aid in the movement of the carrier tape thereby, and said ridge-free region being disposed to accommodate the passage of a sewing machine needle.

2. A carrier tape for sliding clasp fasteners as defined in claim 1 wherein said ridges are formed symmetrically on both faces of said foundation.

* * * * *